United States Patent [19]

Stevens

[11] Patent Number: 4,993,109

[45] Date of Patent: Feb. 19, 1991

[54] THREE-POSITION HINGE FOR FOLDING TABLE

[75] Inventor: Kenneth V. Stevens, Brooklyn, N.Y.

[73] Assignee: Colgate-Palmolive Company, Piscataway, N.J.

[21] Appl. No.: 311,924

[22] Filed: Feb. 16, 1989

[51] Int. Cl.[5] ..... E05D 7/08

[52] U.S. Cl. ..... 16/379; 16/390; 16/392

[58] Field of Search ..... 16/378, 379, 390, 392

[56] References Cited

U.S. PATENT DOCUMENTS

| | | | |
|---|---|---|---|
| 125,827 | 4/1872 | Menzer . | |
| 418,021 | 12/1889 | Harris | 16/390 |
| 418,540 | 12/1889 | Starr . | |
| 753,463 | 3/1904 | Austin . | |
| 1,078,237 | 11/1913 | Baldwin | 16/379 |
| 1,114,026 | 10/1914 | Parsons . | |
| 1,203,076 | 10/1916 | Thum . | |
| 1,326,305 | 12/1919 | Tammi . | |
| 1,385,800 | 7/1921 | Soss . | |
| 1,502,431 | 7/1924 | Hubbard . | |
| 1,605,550 | 11/1926 | Krugly et al. . | |
| 1,676,810 | 7/1928 | Ulrich . | |
| 1,840,249 | 1/1932 | Palumbo . | |
| 1,907,780 | 5/1933 | Froelich . | |
| 2,042,911 | 6/1936 | Stannard | 16/392 |
| 2,153,734 | 4/1939 | Westrope | 16/135 |
| 2,215,088 | 9/1940 | Soss | 16/135 |
| 2,314,337 | 3/1943 | Gessler | 16/135 |
| 2,452,216 | 10/1948 | Yarber | 311/38 |
| 2,539,700 | 1/1951 | Pieper | 311/36 |
| 2,683,278 | 7/1954 | Timken | 16/379 |
| 2,685,488 | 8/1954 | Duncan | 311/61 |
| 2,731,317 | 1/1956 | Duncan | 311/61 |
| 3,289,612 | 12/1966 | Mouw | 108/50 |
| 3,351,402 | 11/1967 | Miller | 16/390 |
| 3,606,450 | 9/1971 | Sedgwick | 297/149 |
| 4,301,744 | 11/1981 | Walter | 108/78 |
| 4,606,279 | 8/1986 | Tucker | 108/78 |

FOREIGN PATENT DOCUMENTS

| | | | |
|---|---|---|---|
| 237789 | 9/1987 | European Pat. Off. | 16/379 |
| 672700 | 11/1964 | Italy | 16/262 |
| 704981 | 4/1966 | Italy | 16/378 |

OTHER PUBLICATIONS

CPL Promotional Literature Showing Conventional Folding Table Cart on Right Hand Side.

SICO Promotional Literature Showing Conventional Folding Table Cart.

*Primary Examiner*—Richard K. Seidel

*Assistant Examiner*—Carmine Cuda

*Attorney, Agent, or Firm*—Richard J. Ancel; Robert C. Sulligan; Murray M. Grill

[57] ABSTRACT

A three-position hinge, for mounting a leaf portion to a center portion of a folding table so as to be pivotable between upward, horizontal, and downward positions closely spaced to the center portion, includes a first mounting plate secured to one horizontal surface of the center portion, a recess formed adjacent the first mounting plate recessed into the center portion, a first pivot member integral with the first mounting plate having a pivot pin positioned in the recess, a second mounting plate secured to the leaf portion, and a second pivot member integral with the second mounting plate and provided with a pivot sleeve which is coaxially mounted on the pivot pin. The pivot axis of the pivot pin is positioned equidistant from the upper and lower plane surface and the lateral edge of the center portion in order to maintain the close spacing in the three positions.

11 Claims, 4 Drawing Sheets

FIG. 1
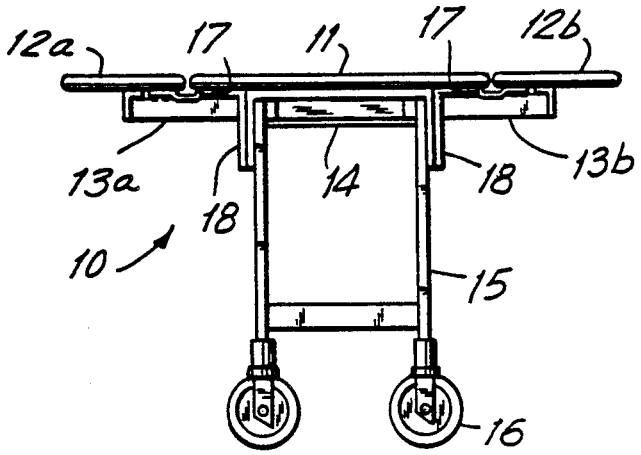
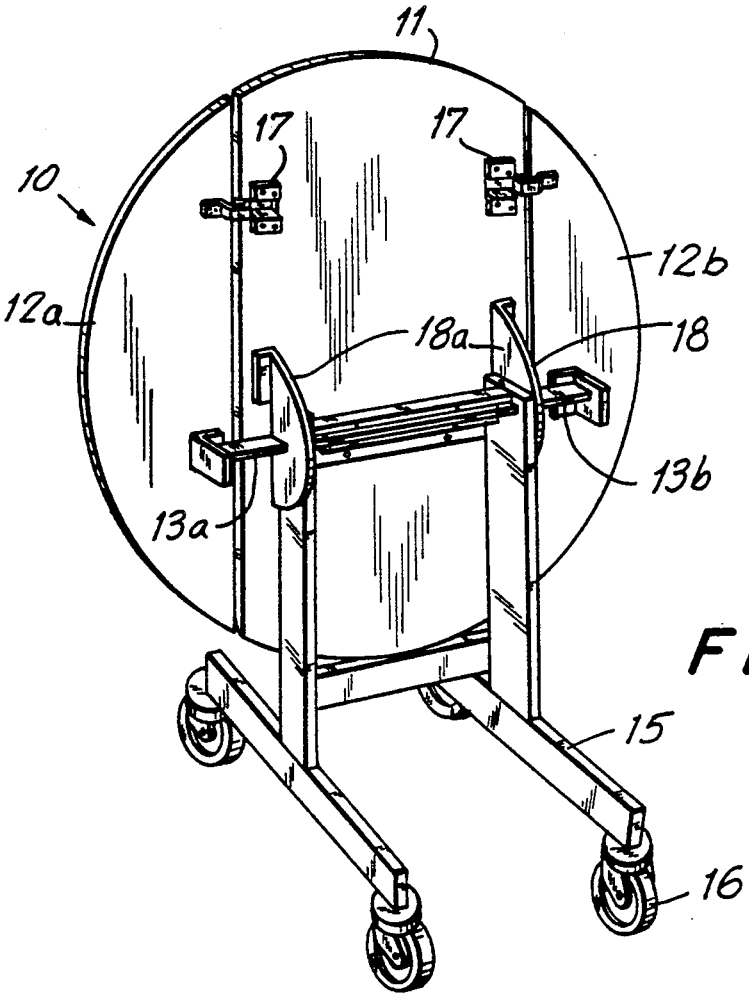
FIG. 2

FIG. 3
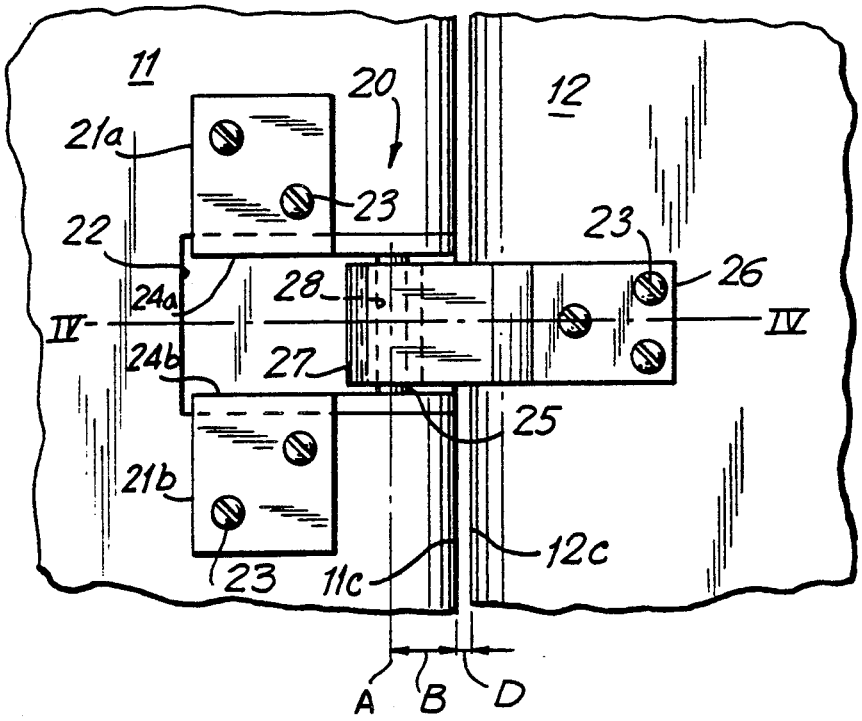
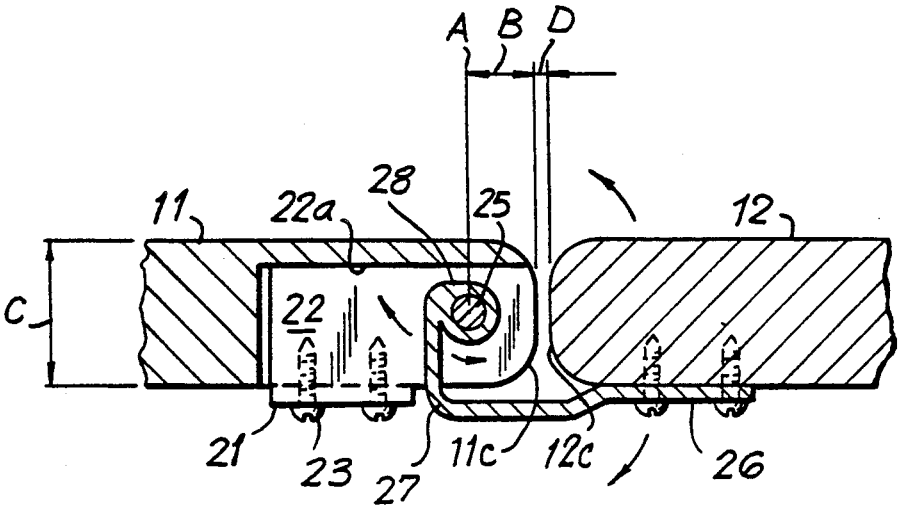
FIG. 4

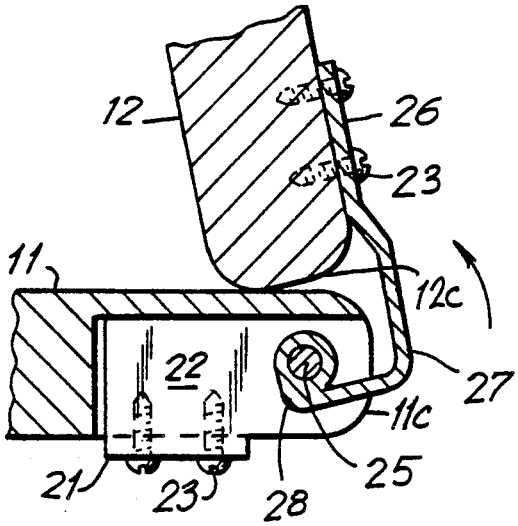
FIG. 5a
FIG. 5b
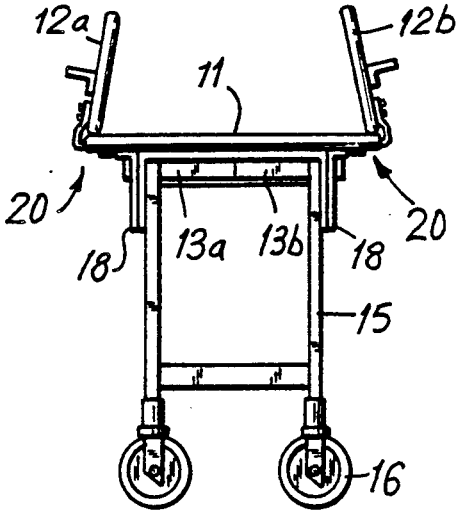
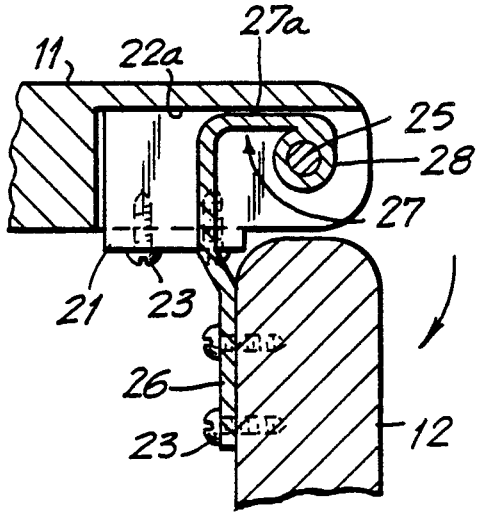
FIG. 6a
FIG. 6b
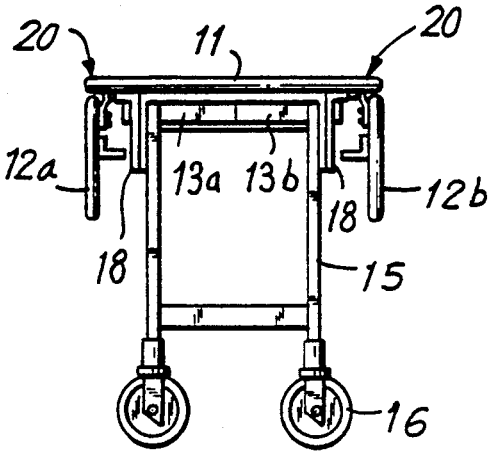

THREE-POSITION HINGE FOR FOLDING TABLE

FIELD OF THE INVENTION

This invention generally relates to a hinge for a folding table, and more particularly, to a three-position hinge which allows an attached leaf of a table to fold to upward, horizontal, and downward positions.

BACKGROUND ART

Folding or drop-leaf tables are well-known in the art, for example, as shown in U.S. Pat. No. 1,840,249 to Palumbo. Hinges mounted between a center portion and a side leaf of the table allow a 90 degree pivoting movement of the leaf from the horizontal to the downward position so that the table can be used or stored in a smaller space. Some folding tables have the center portion pivotably mounted on an open base so that the table can be pivoted to a vertical position and stacked or nested in parallel with other tables.

A further development in folding tables has been the use of three-position hinges to also allow the leaf to be pivoted to an upward position, so that the table has a smaller profile and the leaf keeps objects placed on the table from falling off when the table is moved or wheeled about. However, conventional three-position hinges generally extend outwardly from the edge of the center portion in order to provide the folding leaf clearance for 180 degrees of movement through the three positions. This construction has the disadvantage of an unsightly appearance due to the edge of the leaf becoming spaced from the edge of the center portion by a wide gap when it is pivoted to the downward or upward positions.

Concealed hinges are well-known in the art, for example, as shown in U.S. Pat. Nos. 1,114,026 to parsons, 1,326,305 to Tammi, 1,502,431 to Hubbard, or 2,215,088 to Soss. However, such concealed hinges are generally of the two-position type having only 90 degrees of pivoting movement, and are not suitable for three-position movement.

Accordingly, it is a principal object of the invention to provide a three-position hinge which allows a movable member to pivot through 180 degrees of movement relative to a stationary member while keeping the edges of the members close together so that no unsightly gap is created therebetween at any of the three positions. A further object is to provide a folding table which utilizes three-position hinges to allow the leaf to be moved between a stable upward position, closely spaced horizontal position, and a vertical lower position.

DISCLOSURE OF THE INVENTION

In accordance with the invention, a three-position hinge, for mounting a generally flat, movable member of a given thickness to be pivotable between upward, horizontal, and downward positions closely spaced to a flat stationary member of substantially the same thickness extending in a horizontal direction, comprises a first mounting plate secured to one horizontal surface proximate a lateral edge of one of said movable and stationary members, a recess formed adjacent said first mounting plate which is recessed a given depth into said one horizontal surface in the direction of the thickness of said one member and has a given width in a lateral direction parallel to said lateral edge of said one member, a first pivot member formed integrally with said first mounting plate positioned along one lateral side of said recess and having a pivot pin mounted thereto extending in said lateral direction across said width of said recess, wherein said pivot pin has a pivot axis along said lateral direction positioned approximately halfway between the thickness of said one member and spaced from said lateral edge of said one member by a distance approximately equal to one-half of said thickness, a second mounting plate secured to a corresponding surface proximate an opposing lateral edge of the other of said movable and stationary members, wherein said opposing lateral edges of said movable and stationary members extend in parallel in said lateral direction and are closely spaced facing each other, and further wherein said second mounting plate mounted to said other member has one end extending along said corresponding surface of said other member toward said pivot pin, and a second pivot member having one end integrally fixed to said one end of said second mounting plate and its opposite end provided with a pivot sleeve which is coaxially mounted on said pivot pin.

With this structure, the movable member can be pivoted to the upward, horizontal, and downward positions relative to the stationary member while keeping its lateral edge spaced by the same close spacing to the stationary member. This result is obtained due to the pivot axis of the pivot pin being positioned approximately equidistant from the lateral edge and from the upper and lower surfaces (in the thickness direction) of the stationary member.

In a preferred embodiment, the first mounting plate includes a pair of mounting portions on each lateral side of the recess, and the first pivot member includes a pair of pivot portions on each lateral side of the recess having the pivot pin extending therebetween across the width of the recess. The three-position hinge of the invention is utilized for mounting a folding leaf to a stationary, center portion of a folding table. The second pivot member is accomodated within the bottom of the recess when the leaf is pivoted to the downward position relative to the stationary member.

As a further feature, the lateral edge of the leaf abuts the upper surface of the center portion of the table when the leaf is pivoted to an upward position which is greater than 90 degrees from the horizontal position, so that the leaf is held stably in the upward position by gravity. Small variations may be made in the position of the pivot pin and the configuration of the pivot member to accomodate different thicknesses in the table portions and to position the contact point of the leaf farther in back of the position of the pivot pin for greater stability in the upward position.

Other objects, features, and advantages of the present invention will become apparent from the following detailed description of the best mode of practising the invention when considered in conjunction with the drawings, as follows:

BRIEF DESCRIPTION OF THE DRAWINGS

FIG. 1 is a side view of a folding table utilizing the three-position hinge in accordance with the invention;

FIG. 2 is a perspective view showing the folding table pivoted vertically on its base for parallel storage;

FIG. 3 is a plan view of the three-position hinge in accordance with the invention;

FIG. 4 is a side view of the hinge in FIG. 3 taken along view line IV—IV;

FIG. 5*a* is a side view as in FIG. 4 in which the movable member (leaf) is pivoted upward;

FIG. 5*b* shows a folding table with hinged leaves pivoted upward corresponding to FIG. 5*a;*

FIG. 6*a* is a side view as in FIG. 4 in which the leaf is pivoted downward;

FIG. 6*b* shows a folding table with hinged leaves pivoted downward corresponding to FIG. 6*a*.

BEST MODE OF CARRYING OUT THE INVENTION

Figure 7A:
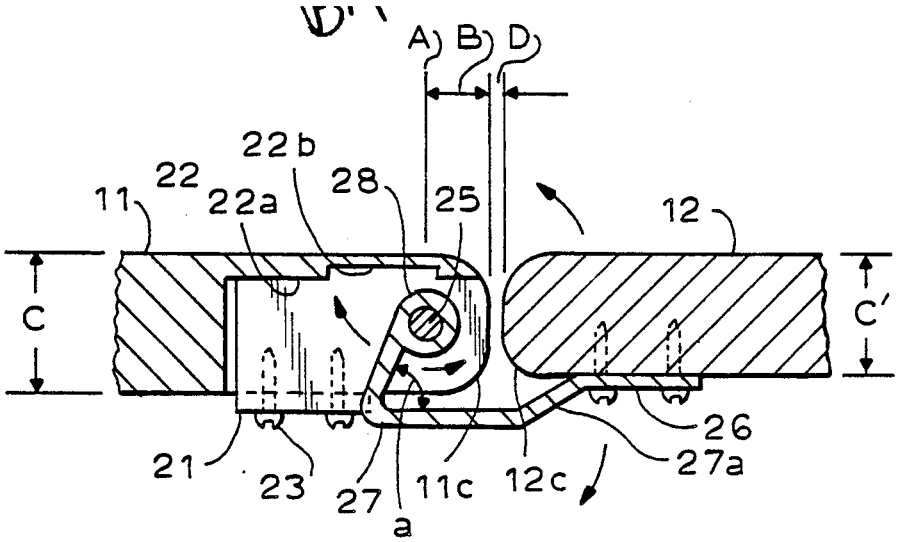
FIGS. 7*a*, 7*b*, and 7*c* show a variation of the three-position hinge which has modified features.

The three-position hinge according to the invention is particularly suited for use with a folding table in which the leaves are folded to an upward position when the table is moved or wheeled about with objects placed on it, a horizontal position when the full surface area of the table is to be used, and a downward position when a reduced surface area is needed or the table is to be stored. A preferred embodiment of the three-position hinge as utilized with such a folding table is described below. However, it is to be understood that the three-position hinge of the invention can be applied equally to other uses wherein a movable member is to be pivoted relative to a stationary member through 180 degrees or more with its lateral edge kept in close proximity to the lateral edge of the stationary member.

Referring to FIG. 1, a folding table 10 illustrative of the invention has a table assembly formed by a center portion 11 which is stationary relative to side leaves 12*a*, 12*b* which are pivotable between upward, horizontal, and downward positions. The side leaves 12*a*, 12*b* are stably held in the horizontal position by respective slide bars 13*a*, 13*b*, which are pulled out on each side, guided along guide portion 14, so that one end thereof abuttingly supports the lower surface of each side leaf. The table assembly is supported on a base 15 which may be mounted on wheels 16.

As shown more clearly in FIG. 2, the folding table preferably has the function of allowing the entire table assembly to be pivoted vertically on the base, so that it can be nested in parallel with other tables for storage. The center portion 11 is supported on rails 17 which are fixed to semicircular pivot plates 18. The pivot plates 18 are pivotably supported to the upper columns of the base 15 at respective pivot points. Each pivot plate 18 has an arcuate guide groove 18*a*, and a locking pin 19 is fixed to the base and engaged in the groove for locking the pivot plate at positions corresponding to the horizontal and vertical positions of the table assembly.

Referring to FIG. 3, a three-position hinge 20 for mounting the pivotable side leaf 12 to the stationary center portion 11 of the table assembly has a pair of first mounting plates 21*a*, 21*b* spaced apart on each lateral side of a recess 22 formed into the thickness of the stationary portion 11. The lateral direction is taken to be parallel to the opposing lateral edges 11*c*, 12*c* of the stationary portion 11 and movable leaf 12, respectively. The first mounting plates 21*a*, 21*b* are secured to the planar (horizontal) surface of the stationary portion 11 by screws 23 or other suitable fasteners.

Integrally formed with the first mounting plates 21*a*, 21*b* are a corresponding pair of first pivot members 24*a*, 24*b*, respectively, which are positioned along each lateral side in the recess 22 extending to the lateral edge 11*c* of the stationary portion 11. A pivot pin 25 is mounted between the ends of the pivot members 24*a*, 24*b* near to the lateral edge 11*c*. The pivot axis A of the pivot pin 25 is recessed from the lateral edge 11*c* by a distance B which is approximately equal to one-half the thickness of the stationary portion 11, as explained further below. The lateral edges 11*c* and 12*c* are closely spaced facing each other by a small distance D.

A second mounting plate 26 is secured to the planar surface of the movable leaf 12 by screws 23 or other suitable fasteners and extends toward the pivot pin mounted in the recess 22 of the stationary portion 11. A second pivot member 27 is integrally formed with the second mounting plate 26 and has a sleeve 28 which is coaxially supported on the pivot pin 25. The second pivot member is preferably made of tempered steel or other rigid material so that it does not deform under load in the various positions.

The operation of the three-position hinge will now be described with reference to FIGS. 4, 5*a*, 5*b*, 6*a*, and 6*b*. As shown in FIG. 4, the stationary portion 11 has a given thickness C. The pivot pin 25 has its pivot axis A positioned at the midpoint of the thickness C. As mentioned previously, the pivot axis A is positioned approximately in the middle of the thickness C and is recessed from the lateral edge 11*c* by the distance B which is also approximately one-half the thickeness C. Therefore, when the movable leaf 12 is pivoted through 180 degrees between the upward and downward positions, the lateral edge 12*c* of the leaf is kept closely spaced, i.e. nose-to-nose, to the upper, lower, and lateral surfaces of the stationary portion 11, and avoids any unsightly appearance caused by a widening gap therebetween.

In FIG. 5*a*, the movable leaf 12 is shown in the upward position relative to the stationary portion 11. The movable leaf is pivoted beyond the vertical line, i.e. greater than 90 degrees from the horizontal direction, so that its lateral edge 12*c* closes the distance D and abuts on the upper planar surface of the stationary portion 11 at a contact point in back of the position of the pivot pin. The leaf 12 is held in this position stably upright at an angle to the vertical direction by the force of gravity on the weight of the leaf. As shown in FIG. 5*b*, the leaves 12*a*, 12*b* folded in the upward position reduce the sideward profile of the table so that it can be moved or wheeled about more easily, as well as prevents objects placed on the center portion 11 from falling off.

In FIG. 6*a*, the movable leaf 12 is shown in the downward position relative to the stationary portion 11. The second pivot member 27 is formed with a back surface 27*a* which is accomodated by a small clearance from the bottom 22*a* of the recess 22 when the leaf is pivoted downward from the horizontal direction. Folding the leaves 12*a*, 12*b* in the downward position allows the table to be moved easily about or stored in a smaller area. The clearance of the bottom recess from the second pivot member 27 defines the downward position and can prevent the leaf from flapping against the base 15 when the table is wheeled about.

Figure 7B:
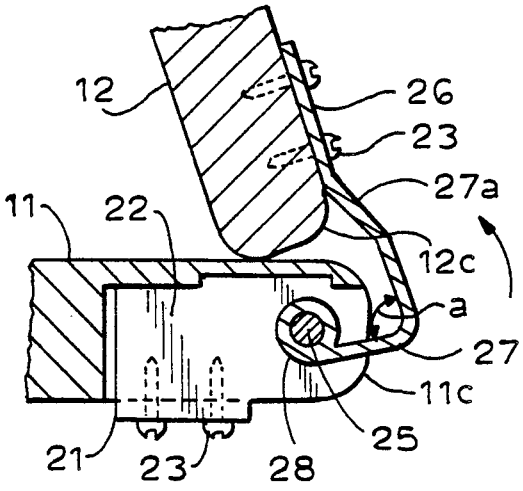
Figure 7C:
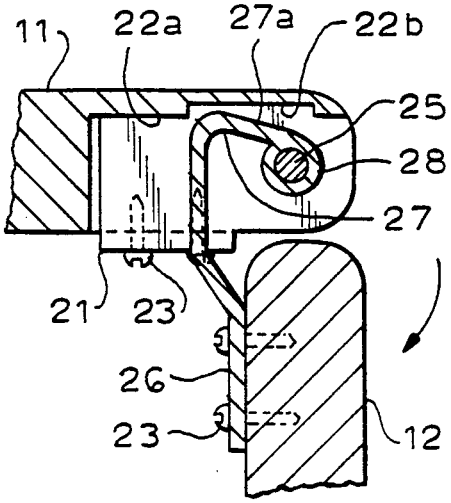

A slightly modified version of the three-position hinge is shown in FIGS. 7*a*–*c* has small variations in the position and structure of the second pivot member which provides additional features. The second pivot member 27 is formed with an angle "a" which is less than perpendicular, i.e. about 80 degrees, to the portion which extends to the sleeve 28 supported on the pivot pin 25. It also has a lengthened doubly-bent portion 27*a* extending to the second mounting plate 26. As shown in FIG. 7*b*, the slightly acute angle "a" allows the leaf 12 to be swung further back from the vertical in the upward position, and for the contact point of the nose 12c of the leaf to be farther back from the position of the pivot pin, as indicated by the distance E, so that it is held more stably in the upward position with a leverage effect by gravity. The longer run of the doubly-bent portion 27a allows the second pivot member 27 to be mounted to a leaf which has a lesser thickness C' than the thickness C of the center portion of the table, thereby allowing it to be made thinner and lighter for ease of use and a better aesthetic appearance. The center portion 11 is formed with a second step or recess 22b for accomodating the acute angle of the second pivot member 27.

From the foregoing description, it will be recognized by those skilled in the art that the present invention provides a three-position hinge which is concealed and allows the movable member to be pivoted through 180 degrees or more without widening the close spacing between the lateral edges of the stationary and movable members, thereby greatly improving its aesthetic appearance. Furthermore, the hinge as utilized in a folding table can be folded to the downward position from the center portion of the table, and in the upward position at greater than 90 degrees from the horizontal position where the leaf is held stably by gravity.

Numerous modifications are possible in light of the above disclosure. For example, although the preferred embodiment shown in the drawings has the pivot pin provided in the recess between the mounting plates of the stationary member and the pivot sleeve formed on the end of the mounting plate of the movable member, it is also within the scope of the invention to reverse the order or position of the parts or to vary their dimensions and the ranges of movement from those disclosed above. In addition, other small variations may be made to obtain a desired interrelationship of the parts and their functions. For example, the position of the pivot pin may deviate slightly from the midpoint in the thickness of the center portion of the table, the second mounting plate may be mortised into the surface of the leaf or raised therefrom with a spacer, etc.

Therefore, it will be appreciated that other variations of structures, products, and processes may be devised, which are nevertheless considered to be within the spirit and scope of the invention as defined in the claims appended hereto.

I claim:

1. A three-position hinge, for mounting a generally flat, movable member of a given thickness to be pivotable between upward, horizontal, and downward positions relative to a flat, stationary member of a given thickness extending in a horizontal direction and having upper and lower horizontal surfaces, comprising:

a first mounting plate secured to one horizontal surface proximate a lateral edge of said stationary member;

a recess formed adjacent said first mounting plate which is recessed a given depth into said one horizontal surface in the direction of the thickness of said stationary member and has a given width in a lateral direction parallel to said lateral edge of said stationary member;

a first pivot member formed integrally with said first mounting plate positioned along one lateral side of said recess and having a pivot pin mounted thereto extending in said lateral direction across said width of said recess, wherein said pivot pin has a pivot axis along said lateral direction positioned approximately halfway between the thickness of said stationary member and spaced from said lateral edge thereof by a distance approximately equal to one-half of said thickness;

a second mounting plate secured to a corresponding horizontal surface proximate an opposing lateral edge of said movable member, wherein said opposing lateral edges of said movable and stationary members are parallel in said lateral direction and are closely spaced by a small spacing facing each other, and further wherein said second mounting plate mounted to said movable member has one end extending along said corresponding horizontal surface of said movable member toward said pivot pin in said recess of said stationary member; and a second pivot member having one end integrally fixed to said one end of said second mounting plate and its opposite end provided with a pivot sleeve which is coaxially mounted on said pivot pin, whereby said movable member can be pivoted to upward, horizontal, and downward positions relative to said stationary member while keeping its lateral edge spaced closely to that of the stationary member at the three positions, and wherein said lateral edges of and said small spacing between said movable and stationary members are configured such that the lateral edge of said movable member abuts the upper horizontal surface of said stationary member at a contact point spaced by a small distance away from the position of said pivot pin when said movable member is pivoted to the upward position, such that the upward position of said movable member is defined at greater than 90 degrees from the horizontal position, and said movable member is held stably in the upward position with a leverage effect by gravity.

2. A three-position hinge according to claim 1, wherein said first mounting plate includes a pair of mounting portions on each lateral side of said recess in said lateral direction, and said first pivot member includes a pair of pivot portions on each lateral side of said recess in said lateral direction having the pivot pin extending therebetween across the width of said recess.

3. A three-position hinge according to claim 1, wherein said first mounting plate and pivot member are mounted to said stationary member and said second mounting plate and pivot portion are mounted to said movable member, and said second pivot member is accomodated in the depth of said recess when the movable member is pivoted to the downward position by a small clearance which defines the downward position relative to said stationary member.

4. A three-position hinge, for mounting a generally flat, movable member of a given thickness to be pivotable between upward, horizontal, and downward positions closely spaced to a lateral edge of a flat, stationary member extending in a horizontal direction and having upper and lower horizontal surfaces spaced apart by a given thickness, comprising:

a first mounting plate secured to the lower horizontal surface of said stationary member proximate the lateral edge thereof;

a recess formed adjacent said first mounting plate which is recessed a given depth into said lower horizontal surface of said stationary member and has a given width in a lateral direction parallel to said lateral edge of said stationary member;

a first pivot member formed integrally with said first mounting plate positioned along one lateral side of said recess and having a pivot pin mounted thereto extending in said lateral direction across said width of said recess, wherein said pivot pin has a pivot axis positioned approximately equidistant between said upper and lower horizontal surface and spaced from said lateral edge of said stationary member;

a second mounting plate secured to a corresponding lower horizontal surface of said movable member proximate a lateral edge thereof facing said lateral edge of said stationary member and being closely spaced wherein said opposing lateral edges of said movable and stationary members are parallel in said lateral direction and are closely spaced by a small spacing therefrom, said second mounting plate having one end disposed in the direction toward said pivot pin mounted in said stationary member; and a second pivot member having one end integrally fixed to said one end of said second mounting plate and its opposite end provided with a pivot sleeve which is coaxially mounted on said pivot pin, whereby said movable member can be pivoted to upward, horizontal, and downward positions relative to said stationary member while keeping its lateral edge spaced closely to that of the stationary member at the three positions, and wherein said lateral edges of and said small spacing between said movable and stationary members are configured such that the lateral edge of said movable member abuts the upper horizontal surface of said stationary member at a contact point spaced by a small distance away from the position of said pivot pin when said movable member is pivoted to the upward position, such that the upward position of said movable member is defined at greater than 90 degrees from the horizontal position, and said movable member is held stably in the upward position with a leverage effect by gravity.

5. A three-position hinge according to claim 4, wherein said opposite end of said second pivot member is joined to said pivot sleeve by a bent portion which forms an acute angle such that, when said movable member is in the upward position, the contact point of said lateral edge of said movable member with the upper horizontal surface of said stationary member is spaced farther back from the position of said pivot pin than if said bent portion formed a 90 degree angle.

6. A three-position hinge according to claim 4, wherein said movable member is formed with a thickness less than that of said stationary member, and said one end of said second pivot member has a double bend such that it extends to said one end of said second mounting plate to accomodate the lesser thickness of said movable member while maintaining the close spacing of said movable member from said stationary member at the three positions.

7. In a folding table of the type having a base and table portions secured thereon including a generally flat, center portion of a given thickness extending in a horizontal direction, and at least one side leaf portion pivotably mounted to the center portion by one or more hinges, so as to be pivotable between upward, horizontal, and downward positions, an improvement of said hinge comprising:

a first mounting plate secured to one horizontal surface proximate a lateral edge of said center portion;

a recess formed adjacent said first mounting plate which is recessed a given depth into said one horizontal surface in the direction of the thickness of said center portion and has a given width in a lateral direction parallel to said lateral edge of said center portion;

a first pivot member formed integrally with said first mounting plate positioned along one lateral side of said recess and having a pivot pin mounted thereto extending in said lateral direction across said width of said recess, wherein said pivot pin has a pivot axis along said lateral direction positioned approximately halfway between the thickness of said center portion and spaced from said lateral edge thereof by a distance approximately equal to one-half of said thickness;

a second mounting plate secured to a corresponding horizontal surface proximate an opposing lateral edge of said leaf portion, wherein said opposing lateral direction and are closely spaced by a small spacing facing each other, and further wherein said second mounting plate mounted to said leaf portion has one end extending along said corresponding horizontal surface of said leaf portion toward said pivot pin in said recess of said center portion; and a second pivot member having one end integrally fixed to said one end of said second mounting plate and its opposite end provided with a pivot sleeve which is coaxially mounted on said pivot pin, whereby said leaf portion can be pivoted to upward, horizontal, and downward positions relative to said center portion while keeping its lateral edge spaced closely to that of the center portion at the three positions, and wherein said lateral edges of and said small spacing between said center and leaf portions are configured such that the lateral edge of said leaf portion abuts an upper horizontal surface of said center portion at a contact point spaced by a small distance away from the position of said pivot pin when said leaf portion is pivoted to the upward position, such that the upward position of said leaf portion is defined at greater than 90 degrees from the horizontal position, and said leaf portion is held stably in the upward position with a leverage effect by gravity.

8. An improved three-position hinge for a folding table according to claim 7, wherein said first mounting plate includes a pair of mounting portions on each lateral side of said recess in said lateral direction, and said first pivot member includes a pair of pivot portions on each lateral side of said recess in said lateral direction having the pivot pin extending therebetween across the width of said recess.

9. An improved three-position hinge for a folding table according to claim 7, wherein said first mounting plate and pivot member are mounted to said center portion and said second mounting plate and pivot portion are mounted to said leaf portion, and said second pivot member is accomodated in the depth of said recess when the leaf portion is pivoted to the downward position.

10. An improved three-position hinge for a folding table according to claim 7, wherein said opposite end of said second pivot member is joined to said pivot sleeve by a bent portion which forms an acute angle such that, when said leaf portion is in the upward position, the contact point of said lateral edge of said leaf portion with the upper horizontal surface of said center portion is spaced farther back from the position of said pivot pin than if said bent portion formed a 90 degree angle.

11. An improved three-position hinge for a folding table according to claim 7, wherein said leaf portion is formed with a thickness less than that of said center portion, and said one end of said second pivot member has a double bend such that it extends to said one end of said second mounting plate to accomodate the lesser thickness of said leaf portion while maintaining the close spacing of said leaf portion from said center portion at the three positions.

* * * * *